US006285324B1

(12) United States Patent
Korisch et al.

(10) Patent No.: US 6,285,324 B1
(45) Date of Patent: Sep. 4, 2001

(54) ANTENNA PACKAGE FOR A WIRELESS COMMUNICATIONS DEVICE

(75) Inventors: Ilya A. Korisch, Somerset; Louis T. Manzione, Summit; Ming-Ju Tsai, Livingston; Yiu-Huen Wong, Summit, all of NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/396,948

(22) Filed: Sep. 15, 1999

(51) Int. Cl.[7] ..... H01Q 3/02
(52) U.S. Cl. ..... 343/700 MS; 333/26
(58) Field of Search ..... 343/700 MS, 702, 343/770, 830, 795, 833, 786, 789, 873, 916, 872; 333/26, 248

(56) References Cited

U.S. PATENT DOCUMENTS

| | | | | |
|---|---|---|---|---|
| 4,801,765 | | 1/1989 | Moyer et al. | 174/52.4 |
| 5,089,878 | * | 2/1992 | Lee | 357/71 |
| 5,113,466 | | 5/1992 | Acarlar et al. | 385/88 |
| 5,786,626 | * | 7/1998 | Brady et al. | 257/673 |
| 5,826,328 | * | 10/1998 | Brady et al. | 29/827 |
| 5,926,139 | | 7/1999 | Korisch | 343/702 |
| 5,945,891 | * | 8/1999 | Emrick et al. | 333/26 |
| 6,047,467 | * | 4/2000 | Hamzehdoost et al. | 29/827 |

* cited by examiner

*Primary Examiner*—Don Wong
*Assistant Examiner*—Chuc D Tran
(74) *Attorney, Agent, or Firm*—David L. Davis

(57) ABSTRACT

An antenna package for use in a wireless communications device. The package includes a metallic leadframe section having a plurality of leads and a paddle shaped as a planar antenna, and dielectric material encapsulating the paddle and portions of the leads.

9 Claims, 6 Drawing Sheets

ANTENNA PACKAGE FOR A WIRELESS COMMUNICATIONS DEVICE

BACKGROUND OF THE INVENTION

This invention relates to wireless communications devices and, more particularly, to an improved small, low cost antenna package for such a device.

The greater capacity and larger number of providers for Personal Communications Services (PCS) means far greater competition for wireless subscribers. Although total revenue is soaring, revenue per subscriber has been declining as many casual and emergency-only users enter the market. In response, equipment providers are under pressure to keep terminal costs low, and at the same time support an increasing number of features that will increase revenue per subscriber. Wireless data transmission is one of the growth areas for wireless services, with increasing demand for wireless images, financial information and Internet access. Although a conventional cellular phone can be used as a wireless modem to transmit data, transmission rates are low and bit error rates are high. Subscriber acceptance of data via this mode has been relatively weak. Although the higher frequency and bandwidth of PCS provides some improvement, it does not offer the significant increase in bit rate that makes data transmission attractive to a wide customer base.

Antenna diversity does provide this significant improvement. Spatial diversity with a switching algorithm can increase the system gain by 3–5 dB depending on the effectiveness of the algorithm and the isolation between antennas. As an example, a simple switch algorithm monitors only the one antenna signal in use. When this signal falls below some threshold value, it switches to the other antenna. A more complicated algorithm would monitor both antenna signals and switch to the one with the strongest signal even if they are both above the operational threshold. Even more complicated systems would replicate much of the RF train and monitor both signals closer to digital baseband. The higher average gain attained with switched diversity allows lower bit error rates to be achieved at higher data rates.

Realizing enough separation between the antennas is an important consideration in spatial diversity on a handset. Horizontal separation is more effective than vertical separation because the decorrelation of the received signal increases faster with horizontal separation, particularly when the vertical beamwidth is smaller than the horizontal beamwidth as it is when one of the antennas is an omnidirectional dipole. The signals have to be essentially uncorrelated and the first null in correlation factor occurs when the distance between antennas is approximately 0.38 times the wavelength. Practically, a correlation coefficient below 0.25, and in some cases below 0.50, can be neglected, providing effective separations of as little as ⅕ the wavelength. This is about 8 cm at 900 MHz and 4 cm at 1.9 GHz. The problem with diversity in a small terminal with a size less than one half the wavelength is that it is difficult to determine the center of the radiation since the entire housing radiates through near field coupling, especially when the antenna is inside. So although the distances required for effective diversity can be realized on the handset, the actual situation is much more complicated. When the antennas are different types and positioned differently, then other types of diversity (directional and polarization) may have an effect as well.

It is therefore apparent that a need exists for small, low cost antennas for use as diversity antennas in handheld wireless communications devices.

SUMMARY OF THE INVENTION

According to the present invention, there is provided an antenna package for use in a wireless communications device. The inventive package includes a metallic leadframe section having a plurality of leads and a paddle shaped as an antenna. Dielectric material encapsulates the paddle and portions of the leads.

In accordance with an aspect of this invention, the paddle is shaped as a planar inverted F antenna (PIFA).

In accordance with another aspect of this invention, the package further includes electronic circuitry attached to the leadframe section and encapsulated by the dielectric material.

Fabrication of the aforedescribed package includes the step of providing a metallic leadframe section having a plurality of leads and a paddle shaped as an antenna. The leadframe section is positioned along the parting line of a mold, and in registration with a mold cavity. The mold cavity is filled with molten dielectric material so as to encapsulate the paddle and portions of the leads. The dielectric material is allowed to harden. The encapsulated leadframe section is removed from the mold, and the unencapsulated portions of the plurality of leads are then trimmed.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
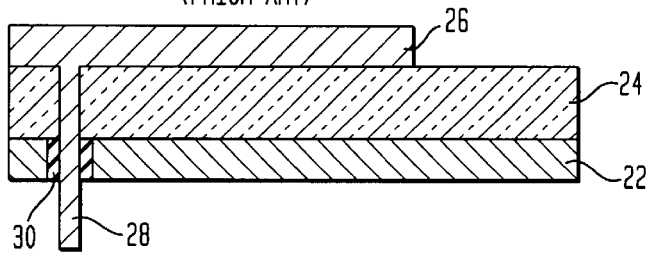
FIG. 1 (PRIOR ART)
FIG. 1 is a cross sectional view of an illustrative planar antenna.

Upon consideration of the problem of providing diversity antennas in a handheld wireless communications device, it was initially decided to use the dipole (whip) as one antenna and utilize as a second antenna one which is small enough to be integrated within the housing of the handheld device. A particularly suitable small antenna is a planar inverted F antenna (PIFA). One such antenna for dual band operation is disclosed in U.S. Pat. No. 5,926,139, issued to Korisch on Jul. 20, 1999. FIG. 1 is a cross sectional view of such an antenna where a ground plane 22 is on a first side of a dielectric substrate 24 and a radiating element 26 is on the other side of the dielectric substrate 24. A feed pin 28 extends through the ground plane 22 and the substrate 24 to couple the radiating element 26 to transceiver circuitry (not shown) and is insulated from the ground plane 22 by an insulating via 30.

Figure 2:
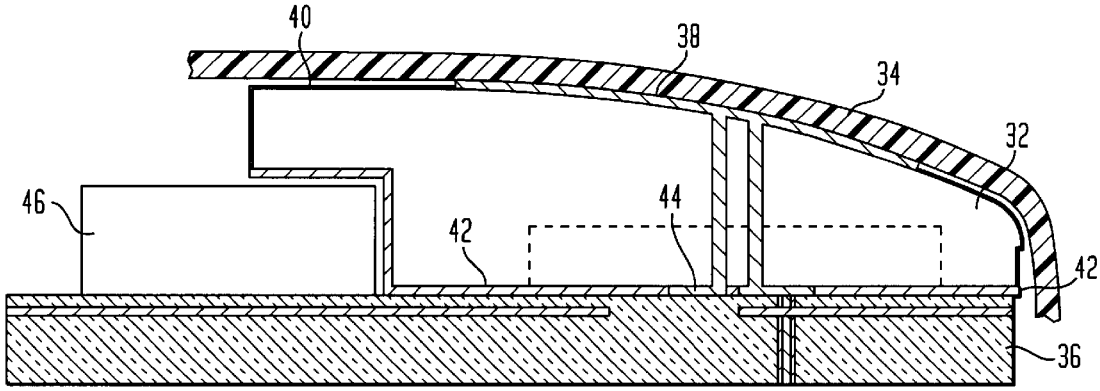
FIG. 2 is a cross sectional view showing a first embodiment of an antenna package constructed in accordance with this invention and mounted with respect to a circuit board, the package being contoured to the outer case of a wireless communications device.

To fit the planar antenna within the housing of the device, polyurethane or other suitable material may be used to form a casting of the unused volume of the interior of the device between the printed circuit board and the housing. As shown in FIG. 2, this casting is utilized to produce a plastic piece 32 which conforms to a portion of the interior space of the device between the outer case 34 and the printed circuit board 36. Alternatively, other known techniques can be utilized to produce a plastic piece conforming to the desired shape. A radiating patch 38 having the desired antenna configuration is then mounted to the plastic piece 32 on a surface 40 remote from the printed circuit board 36. A ground plane 42 is then applied to the opposite surface of the plastic piece 32 and a feed 44 extends through the plastic piece 32. As shown, the plastic piece 32 covers at least a portion of the duplexer 46 so that the metallized surface of the duplexer 46 is used as an extended ground plane for the antenna.

Figure 3:
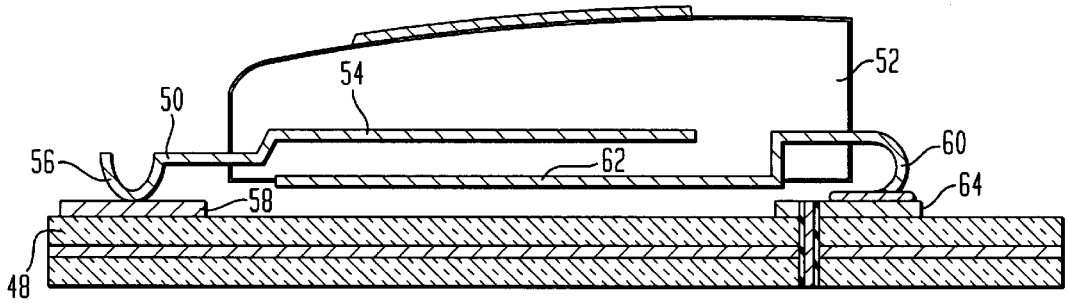
FIG. 3 illustrates two types of interconnection to a printed circuit board for an antenna package according to the present invention.

FIG. 3 schematically illustrates two types of interconnection to a printed circuit board 48. A lead 50 extending out of the molded plastic part 52 and connected to a capacitive feed 54 is formed into a spring clip 56 that contacts a gold plated pad 58 on the printed circuit board 48. Alternatively, the lead 60 connected to the ground plane 62 is reflow soldered to the surface mount pad 64.

According to the present invention, a small low cost antenna package, as discussed above, can be produced from plastic substrates and stamped metallic leadframes. With plastic molding technology, the leadframes can be positioned at the parting line as in conventional integrated circuit packages, or metal can be pre-inserted in a mold at either the top or bottom surface. In addition, two layers of metal can be positioned at the parting line in accordance with the teachings of U.S. Pat. No. 4,801,765, issued on Jan. 31, 1989, to Moyer et al. These metal layers can produce radiating elements, feed planes or ground planes as shown in FIG. 3. The formed metal leads that exit the molded body are the feed and ground interconnections that can be "J" or "gull wing" types. They can be interconnected to the printed wiring board in conventional surface mount assembly operations, or be formed into spring clips as discussed above. Through-hole leads can also be used for antennas although it will be more difficult to shield the radiation which could be emitted on both sides of the board. The molded body itself could be the thermoset molding compound used for integrated circuit encapsulation, but this material is fairly lossy in the gigahertz frequency range. It would therefore be preferable to use a molding plastic having low radio frequency loss at the frequency of interest, as long as it matches the coefficient of thermal expansion of the metal insert. Highly glass-filled grades of polycarbonate, liquid crystal polymer, or polyphenylene sulfide material would work well from both a mechanical and radio frequency loss viewpoints.

Figure 4:
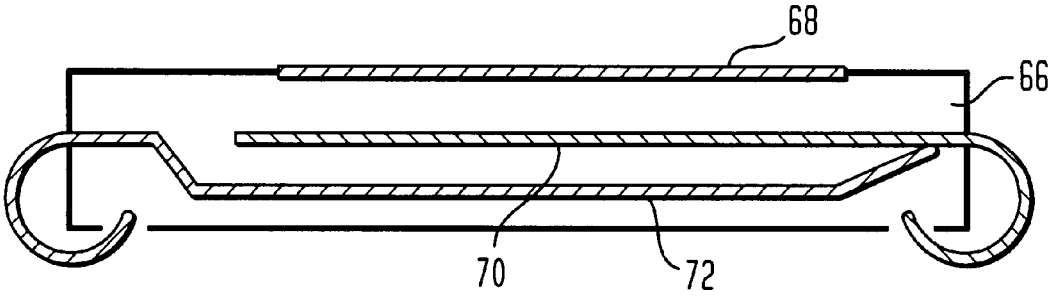
FIG. 4 is a side cross sectional view of a capacitively coupled planar inverted F antenna constructed with a leadframe in accordance with the principles of this invention.
Figure 5:
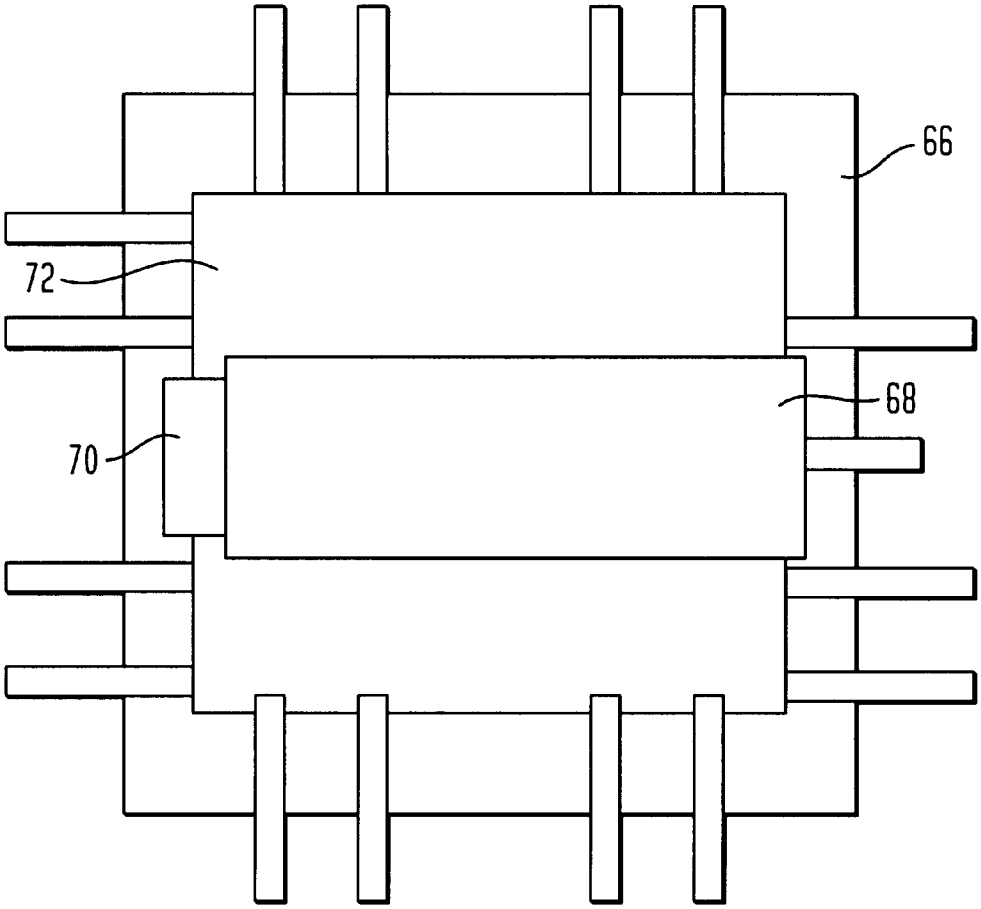
FIG. 5 is a "transparent" top view of the antenna shown in FIG. 4.

FIGS. 4 and 5 illustrate a planar inverted F antenna constructed utilizing the aforedescribed technology, wherein the encapsulating plastic material 66 is shown as being "transparent" so all the elements molded therein are visible. As shown, the inventive package has layers including a radiating element 68, a capacitively coupled feed element 70 and a ground element 72. As an alternative to the design shown in FIGS. 4 and 5, the ground element 72 could be incorporated in the printed wiring board to which the package is mounted.

Since the use of a metal leadframe provides interconnect structure and the use of the molded plastic body provides a packaging medium, the ability to integrate both active and passive radio components with the antenna is now greatly facilitated. The metal leadframes can be stamped to almost any degree of complexity to realize pads and leads for discrete and active components, mini-wiring boards, or multi-chip modules. These frames would be similar to the multi-chip packages that are already on the market, but in the present application part of the leadframe would be devoted to the antenna elements. This provides the RF designer with considerable latitude in bundling components to either eliminate interconnects and connectors or to modularize a specific option. For example, the extra filtering required for data capability could be added onto the leadframe so that the data antenna is a stand-alone option. The multitude of leads that are possible with packages this large means that dozens of the leads could be diverted to the interconnection of these active and passive components. Alternatively, an antenna matching circuit can be incorporated into the leadframe.

Figure 8:
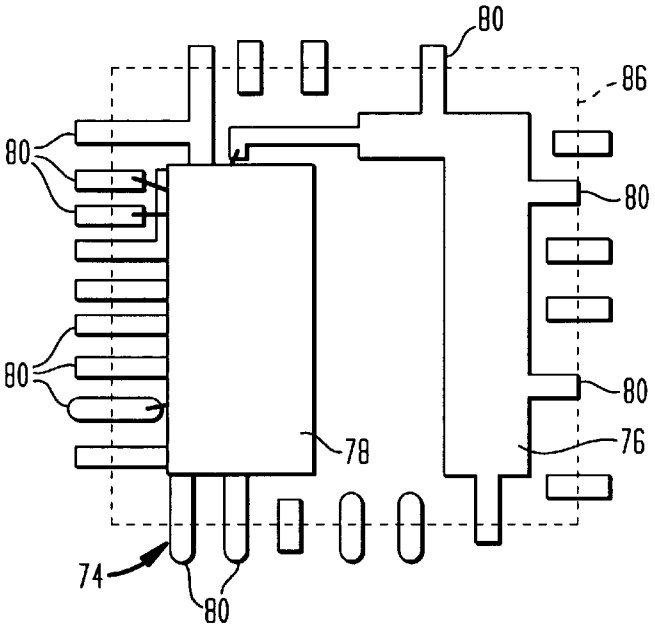
FIGS. 6–9 illustrate an integrated antenna and radio components package with a formed EMI/RFI shield, with FIGS. 6 and 7 being top and side views, respectively, before the shield has been formed and with FIGS. 8 and 9 being top and side views, respectively, after the shield has been formed.
Figure 9:
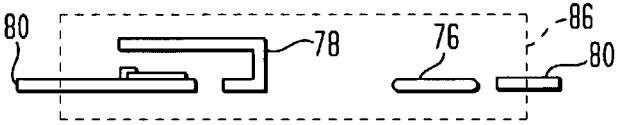
Figure 6:
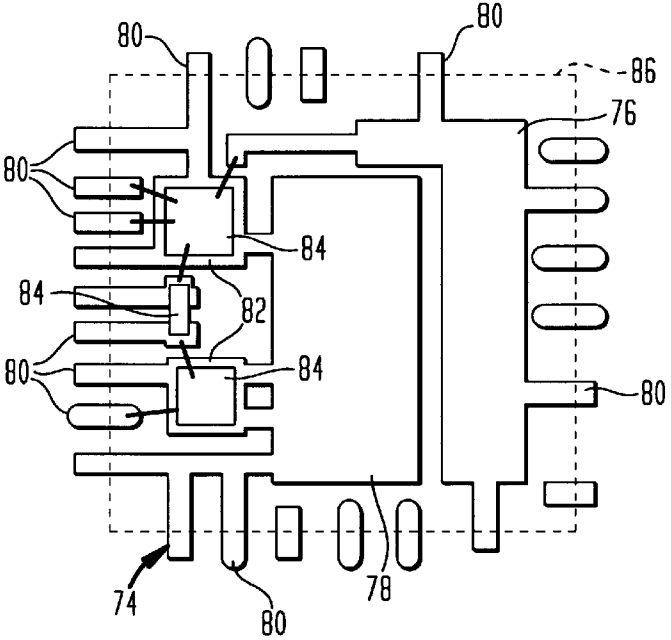
Figure 7:
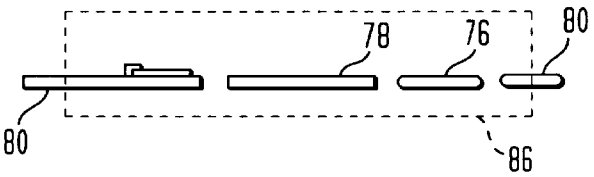

FIGS. 6–9 illustrate the integration of radio components and an antenna into a molded package with a formed shield. As shown, a stamped metal leadframe section 74 is provided, having a first paddle 76 shaped as an antenna, a second paddle 78 which will become a shield, a plurality of leads 80 and additional paddles 82 to which circuit components 84 are mounted in a conventional manner. FIGS. 8 and 9 show the forming of the shield paddle 78 into an electromagnetic and radio frequency shield between the circuit components 84 and the antenna 76. The formation of such a shield is disclosed in U.S. Pat. No. 5,113,466, issued to Acarlar et al on May 12, 1992. After the shield formation, the assembly is encapsulated into a package, the outline of which is shown by the broken line 86 in FIGS. 6–9.

Figure 10A:
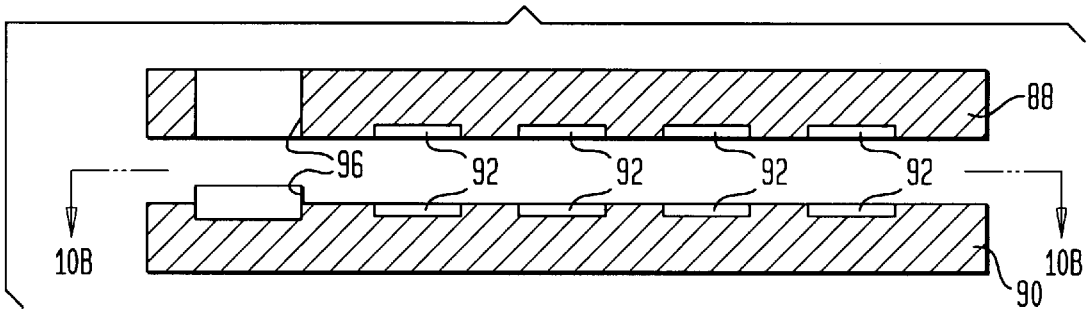
FIGS. 10A, 10B, 11, 12A, 12B, 13A and 13B illustrate steps in the formation of an antenna package according to the present invention.
Figure 10B:
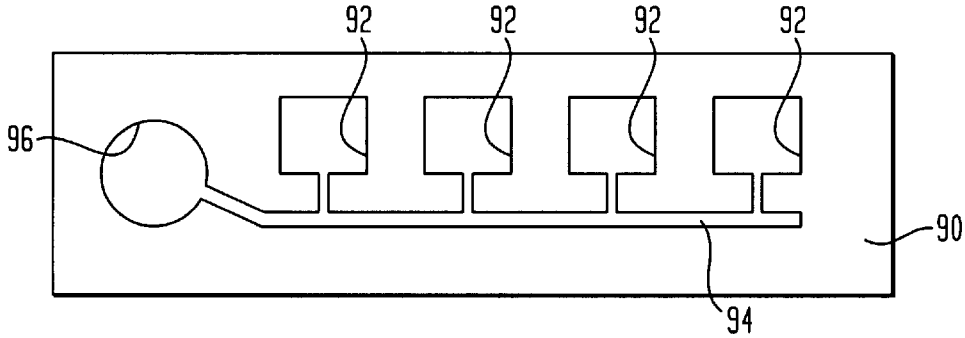

An advantage of the present invention is that the encapsulation of the antenna and associated components can be effected by techniques utilized in the packaging of integrated circuits. Thus, the packaging turns out to be of low cost. Such packaging is illustrated in FIGS. 10A, 10B, 11, 12A, 12B, 13A, 13B, 14 and 15. If the package is to contain active components such as integrated circuits or amplifiers, then the leadframes are placed on a conveyer and pass through a die attach machine. A pick and place machine puts one or more components on each leadframe section. On the same conveyer, the leadframes pass through a wire bond machine where all of the pads on the integrated circuit are wire bonded to the leads of the leadframe section at the rate of two per second. After die attachment and wire bonding, the leadframes are positioned on the parting line of a molding tool. FIGS. 10A and 10B show such a tool which includes two halves 88, 90, each of which includes cavities 92 and a channel 94 connecting the cavities 92 to a fill chamber 96. There may be as many as twelve sections on each leadframe, which are positioned over respective cavities 92. As many as sixteen leadframes can be inserted in a single molding tool so that there can be as many as 192 or more cavities in a large molding tool.

Figure 11:
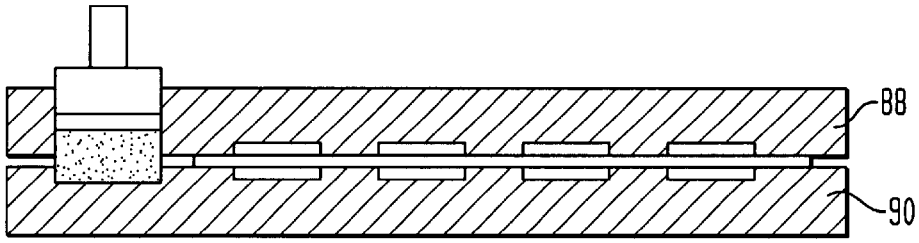
Figure 12A:
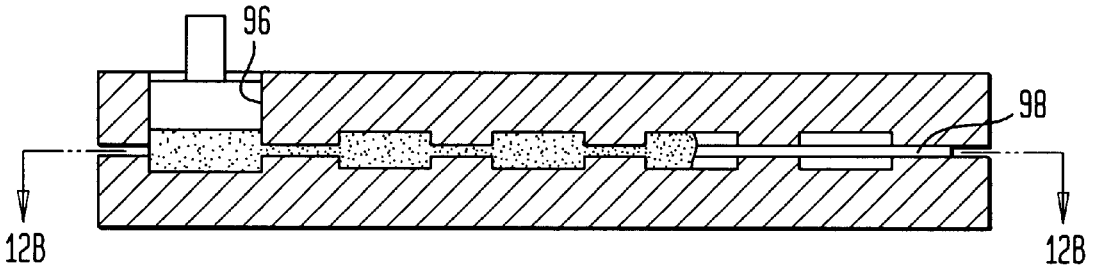
Figure 12B:
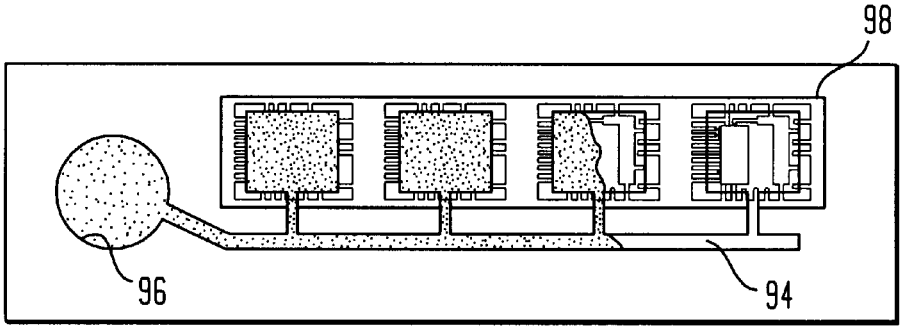

The molding tool is then clamped shut, as shown in FIG. 11, under high pressure which keeps the mold halves 88, 90 from opening when molten plastic is injected under high pressure. A molten plastic material is then injected into the chamber 96 and is distributed through the channel 94 to each of the individual cavities 92, as best shown in FIGS. 12A and 12B. The temperature and injection pressure are carefully controlled so that the molten plastic does not damage the internal features of the components which are being encapsulated.

Figure 13A:
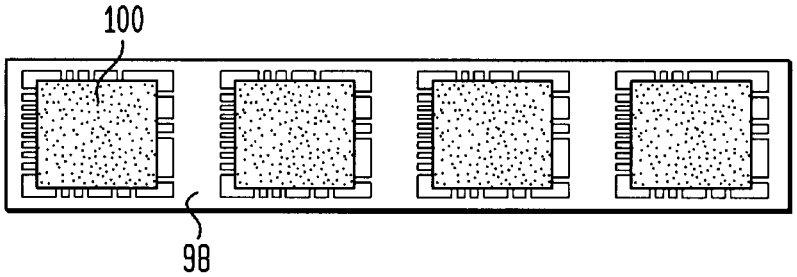
Figure 13B:
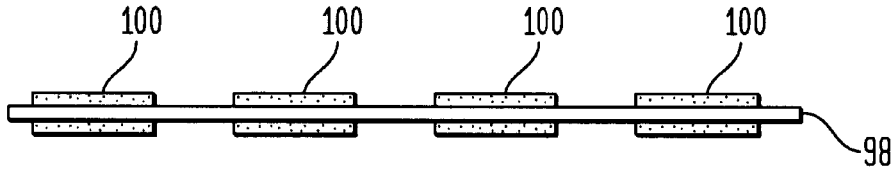
Figure 14:
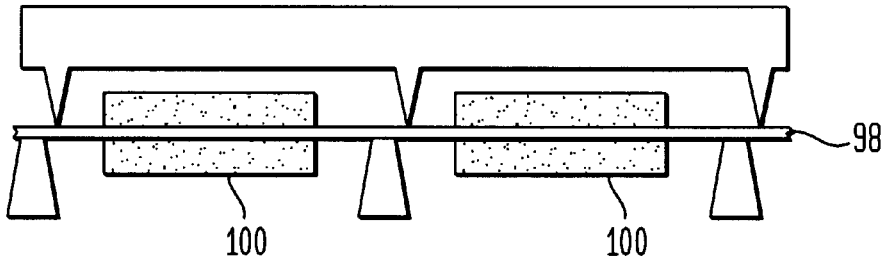
FIG. 14 illustrates the separation of individual antenna packages from a group of leadframes which have been molded together.
Figure 15:
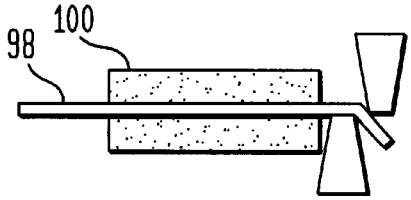
FIG. 15 illustrates the forming of the leads of an individual package.

After the mold is filled, the mold stays clamped shut and the molten plastic hardens for a time period from about 30 to about 180 seconds. If the material can harden just with cooling, then only 30 to 40 seconds are needed for this to occur. If the material is an epoxy material that must polymerize to harden, the time can be as long as three minutes. The mold is then opened and the leadframes are unloaded off the molding tool. Each of the sections of the leadframe 98 is now encapsulated within plastic material 100, as shown in FIGS. 13A and 13B. If the plastic material is an epoxy molding compound, the components may need a post-cure treatment of sustained high temperature to complete the cure process and make the plastic strong enough to withstand the next operations. As many as one thousand components can be post-cured in one batch in one oven. The components are still attached to the leadframes at this point. They are placed on a conveyer belt and pass through a trim and form machine. This is a punch press that has a special stamping tool installed in it. This stamping tool trims away the metal of the leadframe 98 so that the leads are isolated and singulated, as shown in FIG. 14. As the leadframes move through to the next stage of the trim and form press, the leads are formed into the "J" or "gull wing" forms that can be assembled onto a printed wiring board, as shown in FIG. 15. The last stage of the trim and form press separates the components entirely from the leadframe so that they are now individual packages.

The individual packages are then placed on another conveyer belt and are marked with either a transfer printing process (ink stamping) or a laser writing process. In either case, a code mark or other component and manufacturer name is written onto the package. If it is an antenna package including active components, the package is sent for testing. For passive components including only antennas, no testing is needed.

By making the inventive antenna packages similar to integrated circuit packages, the antenna packages can be assembled to printed circuit boards very cheaply using standard "pick and place" technology. In addition, since the inventive antenna package is relatively small, a number of such packages can be assembled to different locations on a printed circuit board to provide the diversity which is desirable for data transmission in a handheld wireless communications device.

Accordingly, there has been disclosed an improved small, low cost, antenna package for a wireless communications device. While various embodiments of the present invention have been disclosed herein, it is understood that modifications and adaptations to the disclosed embodiments are possible. Thus, other types of antennas besides PIFA's can be accommodated, such as dipoles, monopoles, quarterwave or halfwave microstrip patches, top loaded monopoles, slot antennas, spiral antennas, or any antenna element that would conform to the geometrical and size constraints associated with an overmolded lead frame. The antenna does not have to be planar, and can conform to the shape of the housing, or even be imbedded in the housing. It is therefore intended that this invention be limited only by the scope of the appended claims.

What is claimed is:

1. A method for fabricating an antenna package for use in a wireless communications device, comprising the steps of:

providing a metallic leadframe section having a plurality of leads and a paddle shaped as an antenna;

providing a mold having a parting line and at least one cavity;

positioning the leadframe section along the mold parting line and in registration with a mold cavity;

filling the mold cavity with molten dielectric material so as to encapsulate the paddle and portions of the leads;

allowing the dielectric material to harden;

removing the encapsulated leadframe section from the mold; and trimming the unencapsulated portions of the plurality of leads.

2. The method according to claim 1 wherein the step of providing includes the step of shaping the paddle as a planar inverted F antenna (PIFA).

3. The method according to claim 1 wherein the step of providing includes the step of:

attaching electronic circuitry to the leadframe section.

4. The method according to claim 2 wherein the step of providing includes the steps of:

providing an additional paddle between the electronic circuitry and the antenna; and bending the additional paddle to form an electromagnetic and radio frequency shield between the electronic circuitry and the antenna.

5. An antenna package for use in a wireless communications device, comprising:

a metallic leadframe section having a plurality of leads and a paddle shaped as an antenna; and dielectric material encapsulating the paddle and portions of the leads.

6. The package according to claim 5 wherein the paddle is shaped as a planar inverted F antenna (PIFA).

7. The package according to claim 5 further comprising electronic circuitry attached to the leadframe section and encapsulated by the dielectric material.

8. The package according to claim 7 wherein the leadframe section has an additional paddle between the electronic circuitry and the antenna and bent to form an electromagnetic and radio frequency shield between the electronic circuitry and the antenna, the additional paddle being encapsulated by the dielectric material.

9. In combination with a wireless communications device having an insulative outer case and electrical components supported on a printed circuit board mounted within the case, an internal antenna package comprising:

a plastic piece molded to fill a portion of the interior space of the device between the outer case and the printed circuit board; and an antenna on a surface of the plastic piece remote from the printed circuit board.

* * * * *